US005079897A

United States Patent [19]

Muller

[11] Patent Number: 5,079,897

[45] Date of Patent: Jan. 14, 1992

[54] BAG TRANSFER DEVICE

[76] Inventor: Ron Muller, 545 Glengarry Crescent, Box 332, Fergus, Ontario, Canada, N1M 3E2

[21] Appl. No.: 571,694

[22] Filed: Aug. 24, 1990

[51] Int. Cl.[5] ..... B65B 1/00; B65B 61/28

[52] U.S. Cl. ..... 53/284.7; 53/572; 53/385.1; 74/42; 74/522

[58] Field of Search ..... 53/266 R, 384, 385, 53/570, 571, 572, 573, 284.7, 384.1, 385.1; 74/42, 522

[56] References Cited

U.S. PATENT DOCUMENTS

| | | | |
|---|---|---|---|
| 3,444,746 | 5/1969 | Egid | 74/42 |
| 3,731,454 | 5/1973 | Crabb | 53/573 X |
| 3,740,922 | 6/1973 | Liou | 53/384 X |
| 3,822,527 | 7/1974 | Germunson et al. | 53/572 |
| 4,132,049 | 1/1979 | Mullins, Jr. | 53/572 X |
| 4,177,621 | 12/1979 | Powell, Jr. | 53/572 X |
| 4,291,517 | 9/1981 | Lipes | 53/573 X |
| 4,798,042 | 1/1989 | Davis | 53/572 |

FOREIGN PATENT DOCUMENTS

| | | | |
|---|---|---|---|
| 8702001 | 3/1989 | Netherlands | 53/266 R |

*Primary Examiner*—John Sipos

[57] ABSTRACT

A device for transfering filled bags from a volumetric bagger to a bag-closing machine which is spaced a distance from the bagger. The device comprises an arm having a first end and a second end, and having the first end mounted on the volumetric bagger. The arm is adapted to reciprocate between the volumetric bagger and the bag-closing machine. A barb for engaging a filled bag is disposed proximate the second end of the arm. The arm moves away from the volumtric bagger, towards the bag-closing machine, and as the arm moves in this manner, the barb engages the filled bag and the bag is carried from the bagger to the bag-closing machine. As the arm moves back from the bag-closing machine to the bagger, the barb disengages from the bag, which is then released onto the conveyor belt of the bag-closing machine. The arm is linked to the drive mechanism of the bagger in such a manner that transfer of filled bags from the bagger to the bag-closing machine is synchronized with the rate at which bags are filled by the bagger.

4 Claims, 2 Drawing Sheets

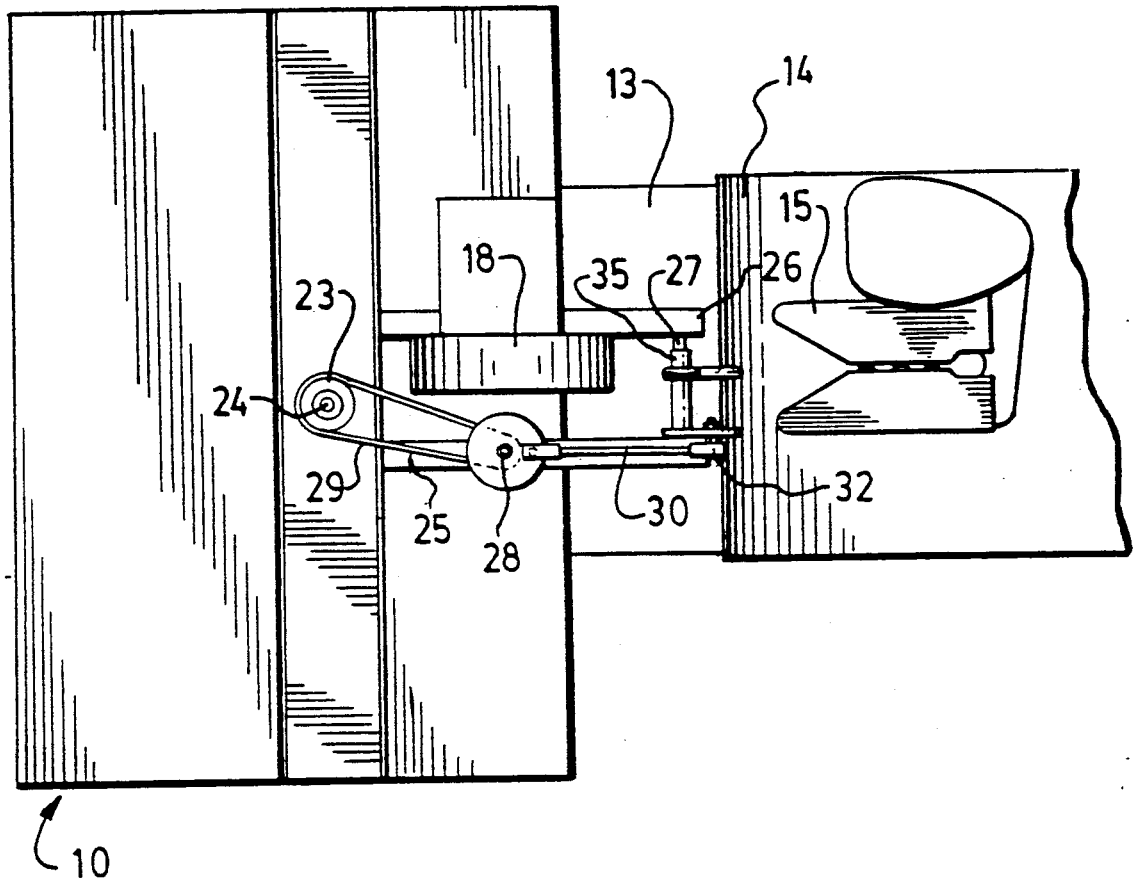
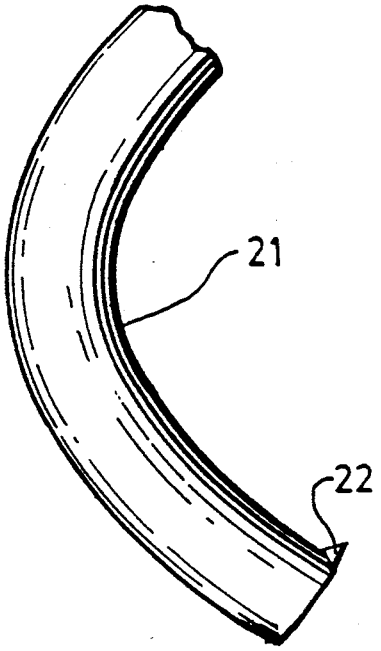
FIG.3.

BAG TRANSFER DEVICE

BACKGROUND OF THE INVENTION

This invention relates generally to a device for transferring bags from a volumetric bagger to a remote bag-closing machine for closure, and more specifically to such a device which is linked to the drive mechanism of a volumetric bagger in such a manner that the transfer of filled bags from the bagger to the bag-closing machine is synchronized with the rate at which bags are filled by the bagger.

SUMMARY OF THE PRIOR ART

Two types of systems have typically been used for filling bags using a volumetric bagger, and then sealing the same.

The first system is a closed system along the lines of the Hamer Model 310 Automatic Bagger, made by Hamer Inc. In this type of system, an automatic bagger/closing machine manufactures the bags, fills them with the required product, and then crimp seals or heat seals the bags. The cost of this type of machine can prove to be prohibitively expensive for many applications.

The second system is one in which a separate volumetric bagger and bag-closing machine are used, and the two machines are disposed a spaced distance from each other. In this type of system, a human operator is used for transferring filled bags from the bagger to the bag-closing machine. The problem with this system is that it is necessary to have the operator present all the time while the machines are running.

SUMMARY OF THE INVENTION

The device of the present invention is adapted for use in the second type of system described above, where a volumetric bagger and bag-closing machine are disposed a spaced distance from each other.

The volumetric bagger has a frame upon which are mounted, amongst other components, a product container and a support for holding a bag as it is filled with the product from the container. The bag-closing machine includes a conveyor belt for moving the filled bags through the machine for closure.

The device of the present invention comprises an arm adapted for reciprocal movement between the bagger and the bag-closing machine. The arm has a first end and a second end, and has the first end mounted on the bagger. The arm has a barb proimate the second end thereof for grasping a filled bag disposed on the support of the bagger, so that as the arm moves away from the bagger towards the bag-closing machine, the filled bag is transferred by the arm from the support to the conveyor belt. As the arm moves back towards the support from the conveyor belt, the barb disengages from the bag and the bag is released onto the conveyor belt. The bag is closed by the bag-closing machine and is moved by conveyor belt to a remote location for packaging.

The arm is connected to the drive mechanism of the volumetric bagger in such a manner that the movement of the filled bags from the bagger to the bag-closing machine is synchronized with the rate at which bags are filled by the bagger.

In the preferred embodiment of the invention the arm is connected to the drive shaft of the bagger so that the rotational motion of the drive shaft is changed into the reciprocal motion of the arm. This is achieved by having a first gear mounted on the frame of the bagger and being driven by the drive shaft of the bagger. A second gear is driven by the first gear and has a disc mounted thereon in such a manner that the motion of the second gear is imparted to the disc. An actuating rod is connected to the disc in such a manner that the rotational motion of the disc produces a back-and-forth motion in the actuating rod. The arm is connected to the actuating rod in such a manner that the back-and-forth motion of the rod causes the second end of the arm to move toward and away from the bagger.

BRIEF DESCRIPTIONOF THE DRAWINGS

The preferred embodiment of the present invention will now be described with the aid of the following drawings in which:

FIG. 2 is a plan view of the volumetric bagger shown in FIG. 1;

FIG. 3 is an enlarged side view of the second end of the arm showing the barb which grasps the filled bags and transfers the same from the volumetric bagger to the bag-closing machine.

DETAILED DESCRIPTION OF THE PREFERRED EMBODIMENT

Figure 1:
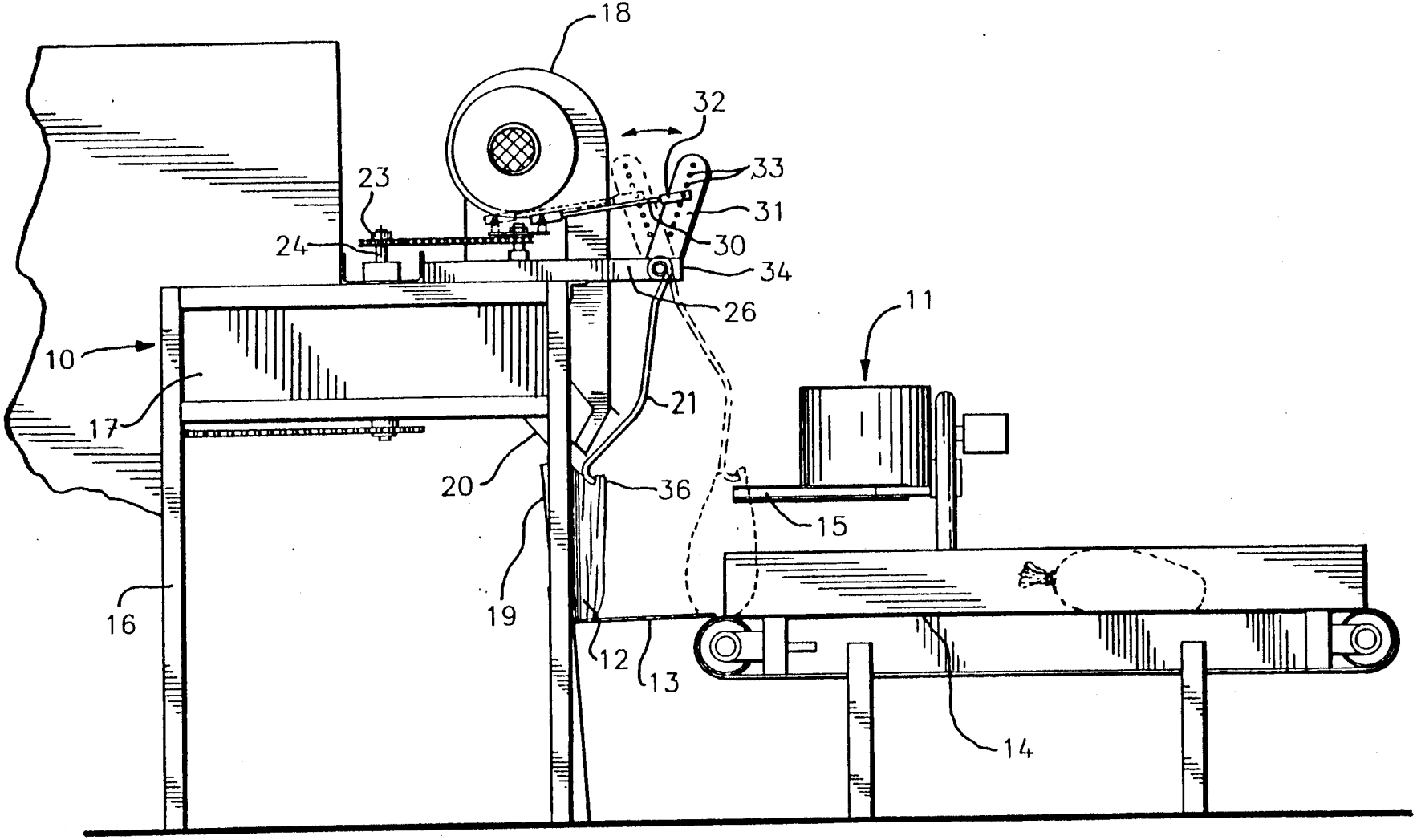
FIG. 1 is a side view of a volumetric bagger, bag-closing machine and the device of the present invention.

Referring to FIG. 1 there is shown a volumetric bagger 10 and a bag-closing machine 11 spaced a distance apart from each other. The volumetric bagger 10 fills the bag 12 with the desired product, which for the purposes of this disclosure is ice, and the bag 12 is then transferred from the bagger 10 to the bag-closing machine 11.

In the prior art, this last step has been accomplished by the use of a human operator who simply takes the bag from the support 13 and moves it across the gap between the two machines and places the bag 12 onto the conveyor belt 14 of the bag-closing machine 11. The bag 12 is then closed by the bag-closing machine using a suitable method, such a stiching or heat sealing, as the bag is moved through the jaws 15 of the machine 11. The closed bag is then carried by conveyor belt 14 to a remote location (not shown) for packaging.

In the preferred embodiment of the invention, the volumetric bagger 10 has a frame 16 upon which is mounted, amongst other components, a product hopper 17, and a fan (not shown) and motor (not shown) which are covered by a housing 18. The bagger 10 is used in conjunction with wicketed bags 12 which are disposed on a bag holder 19. When the motor of the volumetric bagger is started, the fan will automatically open the first bag. The required amount of ice is transferred from the hopper 17 to the bag 12, via the discharge chute 20. The filled bag 12 is removed from the support 13 by the device of the present invention, which device will be described below. The next bag on the bag holder 19 is then automatically blown open and the cycle is repeated.

The device of the present invention may also be used on baggers which use a feed auger instead of an overhead hopper, and in conjunction with baggers in which the bags are opened by other methods.

The device of the present invention comprises an arm 21 which has a first end and a second end. The first end of the is arm is attached to a connecting mechanism (described below) which links the arm 21 to the drive mechanism of the bagger 10. The second end of the arm 21 is substantially hook-shaped, or S-shaped, with the hooked portion opening outwardly from the bagger 10 as is shown in FIG. 1. The hook-shaped, or S-shaped, portion of the arm is disposed substantially parallel to the plane of movement of the arm.

A barb 22 is disposed proximate the second end of the arm and in such a position that it is able to grasp and carry a bag disposed on the support 13 as the arm 21 moves away from the bagger 10 towards the bag-closing machine 11.

The arm 21 is linked to the drive mechanism of the volumetric bagger 10 in such a manner that movement of the filled bags from the support 13 to the conveyor belt 14 is synchronized with the rate at which bags are filled by the bagger.

In the preferred embodiment of the invention, a first gear 23 is connected to the drive shaft 24 of the volumetric bagger 10. First and second brackets 25, 26 are mounted on the frame 16 of the bagger and are connected to each other by a shaft 27. A disc 28 and second gear (not shown) are rotatably mounted on the first bracket 25. The second gear is disposed between the disc 28 and the upper surface 25*a* of the first bracket 25, and the second gear and disc 28 are joined so that they rotate together. A chain 29 drives the second gear, whose motion is imparted to the disc 28.

One end of an actuating rod 30 is fixedly mounted to the disc 28, and the opposite end of the rod is removably connected to a lever 31. The rod 30 is of adjustable length. In the preferred embodiment of the invention, the rod 30 is threaded along its length. An internally threaded tube 32 is adapted for engagement with the lever 31. The tube 32 threads onto one end of the rod 30 and may be threaded to any desired point along the length of the rod 30. Other mechansisms for adjusting the length of the actuating rod 30 may be utilized.

The lever 31 has a plurality of holes 33 therein for varying the position of attachment of the actuating rod 30. This enables the user to adjust the movement of the arm 21 so that the bag 12 is received at the appropriate location on the conveyor belt 14.

The base 34 of the lever 31 is welded to a sleeve 35 which is disposed around the shaft 27. The sleeve 35 is rotatable about the shaft 27. As the disc 28 rotates, the actuating rod 30 describes simultaneous lateral and back-and-forth motions. The back-and-forth motion of the actuating rod 30 is transferred to the lever 31 which consequently moves in an arc as is shown by the arrow in FIG. 1. As the arm 21 is fixedly connected to the sleeve 35, when the sleeve 35 moves in response to movements in the lever 31, the arm moves in an arc and reciprocates between the volumetric bagger and the bag-closing machine.

The device of the present invention is used in the following manner.

For the purposes of illustration, the start of a cycle can be considered to be when the lever 31 and arm 21 are in the position shown in solid lines in FIG. 1. A bag 12 is blown open by the bagger 10 and ice drops from the hopper 17 through the discharge chute 20 and into the bag 12. As the drive shaft 24 rotates in a clockwise direction, the first gear 23 rotates, which in turn causes a rotation in the second gear and in the disc 28. The rotation of the disc 28 causes the actuating rod 30 to move rearwardly, away from the bag-closing machine 11. The lever 31 then begins to move toward the position shown in dotted lines in FIG. 1, and this forces the arm 21 forwardly toward the bag-closing machine 11. As the arm 21 moves, the barb 22 catches the front/rear 36 of the filled ice bag. As the lever 31 continues to move toward the position shown in dotted lines in FIG. 1, the arm moves the filled bag 12 off the support 13 and onto the conveyor belt 14.

As the drive shaft 24 continues to rotate, the disc 28 is ultimately moved to such a position that the actuating rod 30 begins to move forwardly toward the bag-closing machine 11. In response to this motion, the lever 31 begins to move from the position shown in dotted lines in FIG. 1 back to its original position. The arm 21 begins to move rearwardly away from the bag-closing machine 11, thereby causing the barb 22 to disengage from the front/rear 36 of the bag 12. The arm 21 moves back to its original position as shown in FIG. 1, the bagger 10 automatically opens the next bag, ice is dropped into the same via the discharge chute 20 and the cycle begins again.

Variations in the above device will be obvious to those skilled in the art, and such obvious variations are contemplated to fall within the scope of the above-described invention.

The embodiments of the invention in which an exclusive property or privilege is claimed are defined as follows:

1. A bag transfer device for transferring product-filled bags from a volumetric bagger to a bag-closing machine, wherein said bagger includes a frame adapted to mount a plurality of wicketed bags for filling with a product; said bag transfer device comprising a disc mounted on said bagger and rotatably connected to said bagger's drive shaft;

an actuating rod connecting the disc to a lever, said lever being fixedly connected to a sleeve and being rotatable with said sleeve about the sleeve's longitudinal axis in response to movement of the actuating rod; the actuating rod being connectable to the lever at a position remote from the position of attachment of the lever to the sleeve;

a barbed hooking means fixedly attached to said sleeve and being rotatable about said sleeve's longitudinal axis for grasping and moving a filled bag;

so that as the disc rotates the actuating rod and thereby rotates the lever, sleeve and hooking means, the hooking means is able to hook a bag disposed on the bagger and transfer the bag to the bag-closing machine for closure and then return to its original position to hook the next bag for transfer.

2. A bag-transfer device as defined in claim 1 wherein the hooking means is fixedly attached to the sleeve at a position remote from the position of attachment of the lever to the sleeve.

3. A bag-transfer device as defined in claim 1 or 2 wherein the actuating rod is connectable to the lever at a plurality of positions along the length of the lever, said plurality of positions all being remote from the position of attachment of the lever to the sleeve.

4. A bag-transfer device as defined in claims 1 or 2 wherein the actuating rod is of adjustable length.

* * * * *